US010295135B2

(12) United States Patent
Gammer et al.

(10) Patent No.: US 10,295,135 B2
(45) Date of Patent: May 21, 2019

(54) LIGHT MODULE, HEADLIGHT/SPOTLIGHT AND METHOD FOR PROVIDING POLYCHROMATIC LIGHT

(71) Applicant: OSRAM GmbH, Munich (DE)

(72) Inventors: Christian Gammer, Traitsching (DE); Reiner Windisch, Pettendorf (DE)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 16/029,694

(22) Filed: Jul. 9, 2018

(65) Prior Publication Data

US 2019/0024863 A1 Jan. 24, 2019

(30) Foreign Application Priority Data

Jul. 19, 2017 (DE) ..... 10 2017 212 411

(51) Int. Cl.
*F21V 13/08* (2006.01)
*F21S 41/176* (2018.01)
(Continued)

(52) U.S. Cl.
CPC ..... *F21S 41/176* (2018.01); *F21S 41/125* (2018.01); *F21S 41/16* (2018.01); *F21V 23/0442* (2013.01);
(Continued)

(58) Field of Classification Search
None
See application file for complete search history.

(56) References Cited

U.S. PATENT DOCUMENTS 6,357,889 B1 * 3/2002 Duggal ..... H01L 25/0753 362/84
2006/0072314 A1 * 4/2006 Rains ..... F21S 41/37 362/231
(Continued)

FOREIGN PATENT DOCUMENTS

DE 102009054067 A1 5/2011
DE 102012201790 A1 8/2013
(Continued)

OTHER PUBLICATIONS

German Search Report based on application No. 10 2017 212 411.3 (9 pages) dated Jan. 30, 2018 (for reference purpose only).

*Primary Examiner* — Crystal L Hammond
(74) *Attorney, Agent, or Firm* — Viering Jentschura & Partner MBB

(57) ABSTRACT

A light module for providing polychromatic light is provided. The light module includes a wavelength conversion element, a first light source for emitting a first light beam in a first wavelength range, and at least one second light source for emitting a second light beam. The element is configured to convert primary light radiated in by the first light beam into a first conversion light and to convert primary light radiated in by the at least one second light beam into a second conversion light. At least the first conversion light and the second conversion light together form a third light beam. The module further includes a control unit configured for predefining a first luminous intensity for the first light source and/or a second luminous intensity for the at least one second light source depending on a measurement of the light color of the third light beam.

16 Claims, 5 Drawing Sheets

(51) Int. Cl.

| | |
|---|---|
| ***F21S 41/125*** | (2018.01) |
| ***F21V 23/04*** | (2006.01) |
| ***F21S 41/16*** | (2018.01) |
| *F21Y 115/30* | (2016.01) |
| *F21Y 113/10* | (2016.01) |

(52) U.S. Cl.
CPC ..... *F21Y 2113/10* (2016.08); *F21Y 2115/30* (2016.08)

(56) References Cited

U.S. PATENT DOCUMENTS

2007/0035707 A1* 2/2007 Margulis ..... G03B 21/26 353/122
2008/0157009 A1* 7/2008 Wittenberg ..... G02B 6/0055 250/494.1
2008/0290251 A1* 11/2008 Deurenberg ..... H05B 33/0863 250/201.1
2011/0001901 A1* 1/2011 Solomon ..... G02B 6/0063 349/65
2012/0026469 A1* 2/2012 Akiyama ..... G02B 27/142 353/20
2012/0099084 A1* 4/2012 Toyooka ..... G03B 21/14 353/85
2012/0133903 A1* 5/2012 Tanaka ..... G03B 21/2013 353/31
2012/0268016 A1 10/2012 Kaiser et al.
2013/0135593 A1* 5/2013 Saitou ..... G03B 21/204 353/31
2013/0155649 A1* 6/2013 Bruemmer ..... G03B 21/14 362/84
2013/0208508 A1* 8/2013 Nichol ..... G02B 6/0013 362/612
2013/0329448 A1* 12/2013 Franz ..... G03B 21/204 362/555
2014/0153214 A1* 6/2014 Bruemmer ..... A61B 1/0653 362/84
2015/0049457 A1 2/2015 Kroell
2016/0010812 A1 1/2016 Kroell et al.

FOREIGN PATENT DOCUMENTS

DE 102012203442 A1 9/2013
GB 2454556 A 5/2009

* cited by examiner

LIGHT MODULE, HEADLIGHT/SPOTLIGHT AND METHOD FOR PROVIDING POLYCHROMATIC LIGHT

CROSS-REFERENCE TO RELATED APPLICATION

This application claims priority to German Patent Application Serial No. 10 2017 212 411.3, which was filed Jul. 19, 2017, and is incorporated herein by reference in its entirety.

TECHNICAL FIELD

Various embodiments relate generally to a light module for providing polychromatic light and to a headlight/spotlight including such a light module. Various embodiments additionally relate to a method for providing polychromatic light. In this description, the term "light" is understood as a generalized designation of electromagnetic radiation that can be emitted in the UV, VIS and IR wavelength ranges. The designation "radiation" is used as an alternative term.

BACKGROUND

The light module includes a wavelength conversion element, a first light source for emitting a first light beam (first primary light) in a first wavelength range onto the wavelength conversion element, and at least one second light source for emitting a second light beam (second primary light) in a second wavelength range onto the wavelength conversion element. The term light beam describes an incidence of primary radiation (excitation radiation), the emission of conversion radiation and the superimposition of non-converted primary radiation and conversion radiation to form a useful light. Primary radiation denotes the excitation radiation of the primary light sources, in particular the radiation that is incident on a wavelength conversion element. The wavelength conversion element is also referred to hereinafter as phosphor element. Primary light sources are light sources used for the excitation (conversion) of the phosphor. In the present case, the primary light sources are e.g. the first light source and/or the at least one second light source.

The first wavelength range and the at least one second wavelength range differ in their dominant wavelength. The dominant wavelength is also referred to as dominance wavelength. This term can be used for laser diodes and LEDs, and also for the conversion properties of phosphor. The dominant wavelength of light of a light color (colored light) is defined in the CIE chromaticity diagram (standard chromaticity diagram) by the point of intersection between the straight line extended from the white point via the determined color locus of the colored light and the spectrum locus of the closest perimeter of the CIE chromaticity diagram. By way of example, efficient red phosphors have a dominant wavelength of approximately 600 nm. The term dominant indicates what color impression is imparted to the human eye by a light emitting diode. The dominant wavelength is also referred to as perceived wavelength or a hue-identical wavelength.

A wavelength-converted part of a primary light that is emitted by a wavelength conversion element or phosphor is referred to as conversion light. The latter is emitted by the phosphor element as a conversion light beam. The present wavelength conversion element is configured to convert the primary light radiated in by the first light beam at least partly into a first conversion light and to convert the primary light radiated in by the at least one second light beam at least partly into second conversion light. If the at least two primary light sources radiate onto the same area of a conversion element having a homogeneous phosphor composition, the first conversion light and the second conversion light do not differ or substantially do not differ. In the general case, the at least two primary light sources can radiate onto different areas of the conversion element. If the conversion element then differs in its phosphor composition with regard to these two areas of incidence, the first conversion light and the second conversion light can have different spectral properties (spectral distribution). In particular, the conversion element has a homogeneous composition, that is to say that the first conversion light and the second conversion light are spectrally identical or substantially spectrally identical. The term spectral distribution denotes the intensity distribution of a radiation over various wavelengths.

The primary light beam (that is to say the first and second light beams) in this case need not impinge on the phosphor simultaneously, rather the respectively assigned primary light sources can be operated for example in a manner clocked with a temporal offset, e.g. also in a push-pull fashion. The primary light beams also need not impinge congruently on the same area of incidence of the phosphor, but rather can regionally only partly overlap or even be completely disjoint. They can also be radiated onto different sides of a phosphor element. The same analogously applies to the conversion light beams. In particular, the two primary light beams impinge on the same area of incidence and overlap completely or substantially completely.

At least the first conversion light and the second conversion light form a third light beam. In the case of a complete conversion, no primary light emerges from the wavelength conversion element. In this case, in particular only the first conversion light and the second conversion light form the third light beam. In the case of the transmissive arrangement in partial conversion as preferred here, part of the unconverted primary radiation emerges from the wavelength conversion element. In the case of a partial conversion, therefore, the mixed light (useful light) results from the superimposition of unconverted primary radiation and conversion light. Given the presence of two primary light sources having different dominant wavelengths in a transmissive phosphor arrangement, the total mixed light is composed of the superimposition of unconverted first primary radiation and first conversion light and also unconverted secondary primary radiation and second conversion light. In this case, preferably, the first conversion light and the second conversion light together with the unconverted first primary light and the unconverted second primary light form the third light beam. In this case, the first conversion light and the second conversion light can have different dominant wavelengths. It is preferred, as explained above, for the first conversion light and the second conversion light not to differ or substantially not to differ spectrally.

SUMMARY

A light module for providing polychromatic light is provided. The light module includes a wavelength conversion element, a first light source for emitting a first light beam in a first wavelength range, and at least one second light source for emitting a second light beam. The element is configured to convert primary light radiated in by the first light beam into a first conversion light and to convert primary light radiated in by the at least one second light beam into a second conversion light. At least the first conversion light and the second conversion light together form a third light beam. The module further includes a control unit configured for predefining a first luminous intensity for the first light source and/or a second luminous intensity for the at least one second light source depending on a measurement of the light color of the third light beam.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

Figure 1:
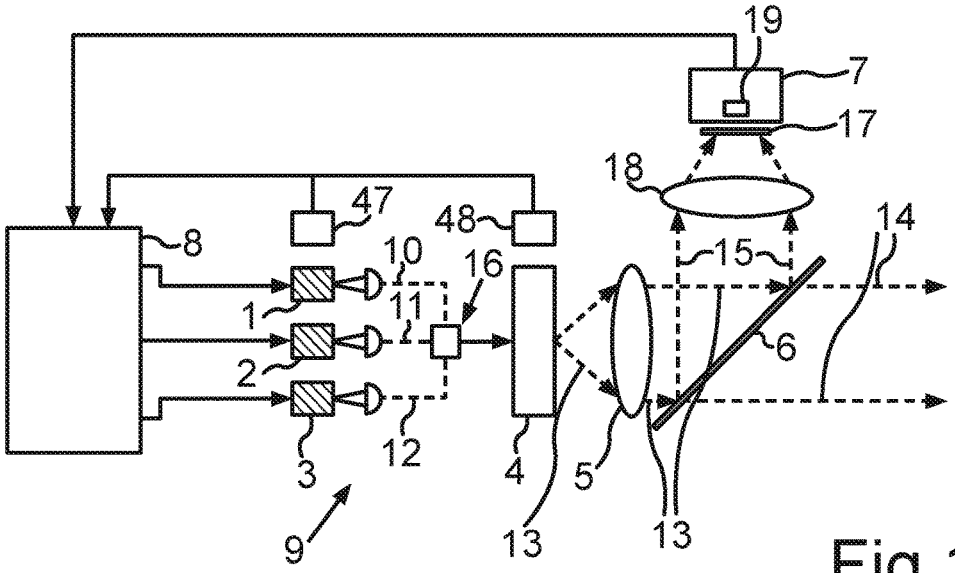
FIG. 1 shows a schematic illustration of a light module for providing polychromatic light, in accordance with various embodiments.

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

Various embodiments are established e.g. in the field of LARP ("Laser Activated Remote Phosphor") systems. Lasers as light sources enable light to be generated in a way that is advantageous for many fields of application. In various embodiments, compared with other types of light sources, for example incandescent lamps or discharge lamps, a laser enables particularly high luminances and also a particularly small beam expansion. A disadvantage of lasers is that white light is not able to be generated directly. Each laser emits light of a defined wavelength. By contrast, white light is composed of polychromatic light of many wavelengths. In various embodiments, white light consists of a continuous spectrum of many wavelengths or of a superimposition of discrete spectra of suitable wavelengths (e.g. blue, green, red, or blue and yellow).

In order to generate white light by means of a laser, in a light module configured as an LARP system, a phosphor as wavelength conversion element is then irradiated by a laser. The phosphor is also referred to as wavelength conversion element. A phosphor can be understood to mean any, e.g. solid, substance which enables the wavelength conversion. The wavelength conversion can be based on fluorescence or phosphorence, for example. It may include an up-conversion to shorter wavelengths and down-conversion to longer wavelengths.

The phosphor at least partly absorbs incident light (primary radiation) from the laser and converts the wavelength of the incident light. The light having a converted wavelength (conversion light) is emitted by the phosphor. White light can be generated e.g. by the partial conversion of blue primary light into yellow conversion light. By way of example, the phosphor (material, thickness) is chosen such that it converts incident blue light (primary light), for example in the wavelength range of 440 to 450 nm, party into yellow conversion light. The yellow conversion light emitted by the phosphor and non-converted primary light, which therefore was not absorbed or converted by the phosphor and passes through the phosphor, can be emitted toward the outside as useful light by the LARP system. This combination of blue residual light and yellow conversion light is perceived as white light. Depending on the wavelength conversion element chosen, a primary radiation (excitation light) can be converted into conversion light of other wavelengths, for example into blue, green, yellow, red light or else into IR radiation in the case of a down-conversion.

A light color can be defined for a light module, e.g. an LARP system. By way of example, the light color can be defined on the basis of a color impression brought about for the human eye. This is the case for example in the context of the CIE standard colorimetric system. This system is based on a color definition of the color impression with the aid of a three-dimensional coordinate system. In this case, a respective third coordinate is unambiguously defined by the specification of two coordinates. For this reason, the light color is specified by coordinates in a two-dimensional coordinate system. In various embodiments, the light color is specified by the specification of two coordinates (for example $c_x$ and $c_y$). The color impression according to the CIE standard colorimetric system is also referred to as color locus. In the context of the present application, therefore, the term light color should always be understood to mean the color locus according to the CIE standard colorimetric system.

The defined wavelength of the light source, in various embodiments of the laser, can be characterized by way of the center wavelength or the dominant wavelength of the emitted laser radiation. The dominant wavelength can be determined by placing a line in the CIE diagram from the point 0.33/0.33 (the white point) through the color locus of the light source, said light intersecting the outer boundary of the color triangle at the dominant wavelength.

Hereinafter it is preferred for the dominant wavelengths of the at least two primary light sources to lie in the wavelength range between 430 and 460 nm.

Hereinafter it is preferred for the center wavelengths or the dominant wavelengths of the first primary light source and of an at least second primary light source to differ by not more than 50, 40, 30, 10, 10, 5, 2 nm, wherein the exemplary wavelength separation is between 5 and 20 nm.

For front headlights in the vehicle sector, the illumination light may be white light whose color locus in a CIE standard chromaticity diagram (1931) lies in the ECE white field in accordance with ECE/324/Rev.1/Adb.47/Reg.No.48/Rev.12.

In this case, the vehicle can be an aircraft or a waterborne vehicle or a landborne vehicle. The landborne vehicle can be a motor vehicle or a rail vehicle or a bicycle. The use of the headlight in a truck or automobile or motorcycle is particularly preferred. The vehicle can furthermore be configured as a non-autonomous or partly autonomous or autonomous vehicle.

In the case of a transmissive LARP system in partial conversion, owing to the wavelength-dependent absorption property of the phosphor used, the resulting light color of the useful light is greatly dependent on the wavelength of the laser or a multiplicity of lasers. In this case, the wavelength of the laser/lasers has to be defined within narrow limits in order to achieve a predetermined light color of the useful light. Moreover, an accurate adaptation of the phosphor to the wavelength of the laser/lasers may be necessary. This results in small manufacturing tolerances and thus high costs during the manufacture of an LARP system or the selection of a suitable phosphor if light of a predetermined light color is intended to be emitted.

Moreover, the laser and/or the phosphor can change their properties depending on an ambient temperature and/or operating temperature. Alternatively or additionally, the laser and/or the phosphor can alter their properties owing to aging. By way of example, the wavelength of the laser varies depending on temperature or depending on aging. By way of example, the absorption and/or the degree of conversion of the phosphor is temperature-dependent and/or subjected to aging. In this case, that proportion of the light radiated in by the laser which is absorbed and converted by the phosphor can vary, and so can the intensity of the conversion light generated. In the case of variation of the properties of laser and/or phosphor, the setting of a predetermined light color of the useful light is no longer ensured.

Various embodiments may enable an improved color fidelity for a light module.

In this case, embodiments and developments of the light module according to various embodiments analogously also develop the method according to various embodiments, and vice versa.

Various embodiments are based on the insight that the light color of the overall useful light can be set or regulated given a suitable choice of different excitation wavelengths of the primary light sources and suitable operation of the at least two primary light sources. In other words, if the incident power of the two primary light sources having different dominant wavelengths is varied, the radiation power of the respective non-converted primary radiation portions and the radiation power of the conversion radiation generated by them also change. The light color of the integral mixed light thus changes in temporal superimposition. Integral here means averaging over a time interval. Specifically, as described in the introduction, the primary light sources need not necessarily all be in operation simultaneously. They can also be operated in a clocked manner and overlap only at times or else not temporally overlap at all (push-pull operation). Simultaneous operation may be provided since the highest total intensity of the integral useful light can then be achieved.

Various embodiments are thus based on a light module for providing polychromatic light, including a wavelength conversion element, a first light source for emitting a first light beam in a first wavelength range onto the wavelength conversion element, and including at least one second light source for emitting a second light beam in a second wavelength range, wherein the first wavelength range and the second wavelength range differ in their dominant wavelength, wherein the wavelength conversion element is configured to convert primary light radiated in by the first light beam at least partly into a first conversion light and to convert primary light radiated in by the at least one second light beam at least partly into a second conversion light, wherein the first unconverted primary light, the at least one second unconverted primary light, the first conversion light and the second conversion light form a third light beam (useful light).

In order to enable an improved color fidelity for a light module, according to various embodiments the light module includes a control unit for predefining a first luminous intensity for the first light source and/or a second luminous intensity for the second light source, which is configured to carry out a setting and/or a readjustment to a desired light color. Therefore, depending on the light color to be set and/or a necessary readjustment to be set to said light color, the control unit predefines the first luminous intensity for the first light source and/or the second luminous intensity for the second light source and/or optionally also for further primary light sources, if present.

The control unit is configured to predefine a relative intensity of the first light source and of the second light source with respect to one another by predefining the first luminous intensity and/or the second luminous intensity. On account of the different wavelength ranges of the first light source and of the second light source having different dominant wavelengths, the light color of the resulting (integral) overall useful light is dependent on the relative intensity of the first light source and of the second light source with respect to one another. Consequently, the control unit is configured to control the light color by predefining the first luminous intensity and/or the second luminous intensity. In various embodiments, the light color is controlled on the basis of a determined measure of the light color. As a result, a correction of the light color is possible for example if the light color lies outside a desired color range.

The first light source and/or the second light source are/is e.g. a laser, for example a laser diode. Alternatively, the first light source and/or the second light source are/is for example also a light emitting diode (LED). What a laser diode and a (non-phosphor-converted) light emitting diode often have in common is that they emit substantially monochromatic or narrowband light. For this reason, it is particularly expedient to couple such a light source or such light sources to a wavelength conversion element in order to generate polychromatic useful light.

A spectral distribution of the light of the first light source and of the second light source is different at at least one wavelength or frequency. With the use of two laser diodes as first and second primary light sources, the peak wavelengths or the dominant wavelengths are different. In various embodiments, the second light source is configured to emit the second primary light beam onto the wavelength conversion element. The dominant wavelengths of the first wavelength range and of the second wavelength range can differ at least by 5 nm, 10 nm, or 20 nm. Embodiments can provide for the dominant wavelengths of the first wavelength range and of the second wavelength range to differ maximally by 40 nm, 20 nm, or 10 nm.

Alternatively, the wavelength conversion element is not situated in the beam path of the second light beam. In this case, the second light source is configured to emit the second light beam directly. By way of example, the second light source is configured to admix the second light beam without conversion by the conversion element for varying the light color.

The wavelength conversion element is configured e.g. to convert the light of the first light source and/or of the second light source to longer wavelengths. In this case, the wavelength conversion element is preferably configured for the partial conversion of the incident light. By way of example, the wavelength conversion element is configured to transmit one part of the incident light and to convert another part of the incident light. The transmitted parts and the converted parts of the incident light can together form the third light beam (useful light). In this case, the transmitted part and the converted part e.g. together form the white light.

The wavelength conversion element can also be configured to convert predominantly the light of the first light source or the light of the second light source.

In some embodiments, the first light source and/or the second light source can operate in full conversion. That means that the wavelength conversion element is configured to completely convert the light of the first light source and/or of the second light source. The wavelength conversion element may include a plurality of subelements for each of the light sources. By way of example, different subelements from among said subelements can have different phosphor properties (e.g. chemical composition, density, layer thickness). Consequently, the subelements can convert the incident light to different proportions and/or into different wavelength regions.

In various embodiments, the control unit is configured to set the light color to a predefined color value by predefining the first luminous intensity and/or the second luminous intensity. Consequently, the control unit can be configured to set the light color to the predefined color value on the basis of the measure of the light color. By way of example, the control unit is configured to compare the measure of the light color with a predefined comparison value in order to set the light color to the predefined color value. In another example, the control unit is configured to compare the light color of the third light beam with the predefined color value. In this case, the control unit can be configured to predefine an altered first luminous intensity and/or a second luminous intensity in the case of a deviation between determined light color and predefined color value.

By way of example, the predefined color value can be defined by an upper limit value and/or a lower limit value. By way of example, the control unit is configured to increase the first luminous intensity and/or to reduce the second luminous intensity if the light color exceeds the upper limit value. Alternatively or additionally, the control unit is configured to reduce the first luminous intensity and/or to increase the second luminous intensity if the light color falls below the lower limit value.

The light module may include a storage unit configured to store a first intensity value for the first luminous intensity and a second intensity value for the second luminous intensity. The control unit can be configured to drive the first light source and/or the second light source depending on data stored in the storage unit. In various embodiments, the control unit is configured to predefine the first luminous intensity and/or the second luminous intensity on the basis of the first intensity value and/or the second intensity value, respectively. The first intensity value and/or the second intensity value can be determined in a calibration process, e.g. during the manufacture of the light module. By way of example, the first intensity value and/or the second intensity value predefine(s) a respective current flow or an electrical power for the first light source and/or the second light source, respectively.

In one development, the light module includes a measuring unit configured to determine a measure of the light color of the third light beam. I various embodiments, the measuring unit measures the light color or the color locus of the third light beam. The measuring unit may include an optical sensor, for example. By way of example, the optical sensor is embodied as an RGB sensor or includes a plurality of individual sensors. In the case of a plurality of individual sensors, a respective color filter can be disposed upstream of each of the individual sensors. Consequently, the light color or the measure of the light color can be determined on the basis of the filter characteristic of the color filters and on the basis of the intensity at the individual sensors.

In another example, the measuring unit includes a sensor having only two channels, of which one for example is in the yellow light range and the other is sensitive in the blue light range. The measuring unit can be configured to determine, on the basis of the relative intensities of the yellow light range and of the blue light range, a degree of conversion of the light of the first light beam and/or of the second light beam by the conversion element. With corresponding calibration, the degree of conversion can be sufficient to regulate the light color or the color locus of the third light beam. The measuring unit may include a diffusing plate in order to intermix different spectral portions of the secondary portion. Measurement errors on account of dispersion effects when determining the light color are minimized as a result.

By way of example, the measuring unit (e.g. in the form of a yellow and a blue detector) is arranged laterally at a light exit plane of the third light beam, such that a laterally emitted portion of the third light beam impinges directly on the measuring unit. In this case, by way of example, the correct color locus is not measured, but the measured signal correlates with the color locus, such that it is suitable for the regulation of the first luminous intensity and/or second luminous intensity.

One development provides for the light module to include a coupling-out element arranged in a beam path of the third light beam, wherein the coupling-out element is configured to split the third light beam into a main portion and a secondary portion, wherein the light module is configured to provide the main portion of the third light beam toward the outside as the polychromatic light, and wherein the measuring unit is configured to determine the measure of the light color on the basis of the secondary portion of the third light beam. The coupling-out element can be configured to couple out the secondary portion from the third light beam. In this case, the secondary portion remains in particular within the light module and e.g. no emission of the secondary portion toward the outside takes place. The light module is configured to provide the main portion of the third light beam toward the outside for illumination purposes. In other words, by emitting the main portion it is possible to provide an illumination function of the light module. Providing the illumination function concerns, for example, illuminating a roadway as vehicle headlight, illuminating a stage as stage spotlight or projecting symbols, images or films.

By contrast, the light module, in particular the measuring unit, can be configured to use the secondary portion for determining the light color. By way of example, the coupling-out element is configured to split the third light beam into the main portion and the secondary portion in a manner free of dispersion, that is to say independently of the wavelength. In this case, the main portion and the secondary portion have the same spectral composition. As a result, by determining the light color of the secondary portion, the light color of the main portion can be simultaneously determined as well. Alternatively, the coupling-out element is dichroic, meaning that individual wavelengths are reflected. In this case, the light color can be determined on the basis of the individual intensities of the dichroically reflected wavelengths. In this case, the light color can be represented e.g. by the light point in accordance with the CIE standard colorimetric system.

By way of example, the coupling-out element is configured as a mirror element, e.g. as a partly transmissive mirror. The coupling-out element can be configured, for splitting the third light beam, to transmit the main portion of the third light beam and to reflect the secondary portion of the third light beam. In this case, the coupling-out element can be configured to reflect a small proportion, e.g. less than 25%, less than 10%, less than 5%, for example 3%, of the third light beam. In other words, the coupling-out element can be configured for splitting the third light beam by partial reflection. The coupling-out element can be configured, for splitting the third light beam, to reflect the main portion of the third light beam and to transmit the secondary portion of the third light beam. In this case, the coupling-out element can be configured to transmit a small proportion, e.g. less than 25%, less than 10%, less than 5%, for example 3%, of the third light beam.

By way of example, the first wavelength range and/or the second wavelength range lie(s) in a blue wavelength range extending from approximately 405 nm to approximately 450 nm. By way of example, the first light source and/or the second light source are/is thus configured for emitting light in a blue wavelength range. Consequently, the light emitted by the first light source and/or the second light source is laser light in a blue wavelength range. Since blue light is the most energetic light portion of the visible spectrum, it can be used particularly advantageously to generate by conversion yellow conversion light which, in superimposition with unconverted blue excitation light, is able to generate white mixed light (useful light).

One development provides for the coupling-out element to be configured to split the third light beam into the main portion and the secondary portion according to a predefined ratio. In this case an illuminance or light intensity of the main portion can be proportional to an illuminance or light intensity of the secondary portion. This makes it possible to determine the light intensity or illuminance of the main portion by determining the light intensity or illuminance of the secondary portion.

One development provides for the measuring unit to be configured to determine a light intensity or illuminance for the secondary portion of the third light beam, and for the control unit to be configured to set the light intensity or illuminance to a predefined luminous intensity value by predefining the first luminous intensity and/or the second luminous intensity. This may be provided e.g. if the illuminance of the main portion is proportional to the illuminance of the secondary portion. In this case, by setting the illuminance of the secondary portion to the predefined luminous intensity value, it is possible for the illuminance of the main portion to be set indirectly to a further predefined luminous intensity value. Consequently, it is possible to ensure the provision of a constant illuminance by the light module toward the outside.

Control of multi-laser packages is advantageously made possible. This involves light sources having a multiplicity of laser diodes, for example 10, 20, 30, 50, 100 laser diodes. By way of example, a plurality of laser diodes from the multiplicity thereof are combined as a light source. Consequently, a plurality of laser diodes combined as a light source can be jointly drivable. By way of example, the first light source and/or the second light source in each case include(s) a multiplicity of laser diodes which are only jointly drivable. By way of example, those laser diodes from the multiplicity thereof which have a similar dominant wavelength form a light source. Similar means, for example, that the deviation of the individual dominant wavelengths among one another does not exceed a predetermined amount, for example not more than +/−2 nm.

Alternatively, the control unit can be configured to randomly select individual laser diodes from among said laser diodes and to control the luminous intensities thereof individually. By varying the luminous intensities of individual laser diodes from among said laser diodes, the light color of the third light beam (useful light) can be variable. In various embodiments, the control unit is configured to vary the luminous intensities of individual randomly selected laser diodes until the light color corresponds to the predefined color value.

One development provides for the control unit to be configured to detect the measure of the light color on the basis of a temperature from a temperature sensor. By way of example, the temperature sensor is configured to detect a respective temperature of the first light source and/or of the second light source. In another example, the temperature sensor is configured to detect a temperature of the conversion element. In yet another example, the temperature sensor is configured to detect an ambient temperature. A combination of a plurality of temperature sensors is also possible. As described in the introduction, the temperature can have an influence on the dominant wavelength of the first light beam and/or of the second light beam. Alternatively or additionally, the temperature can have an influence on the conversion by the conversion element. If the temperature dependencies of the conversion and/or of the dominant wavelength are detected in the context of a calibration, the temperature can permit conclusions to be drawn about the light color or the color locus of the third light beam. Consequently, the temperature can be interpreted as a measure of the light color of the third light beam. By predefining the first luminous intensity and/or the second luminous intensity by means of the control unit depending on the temperature, it is possible to avoid temperature-dictated shifts in the light color or the color locus.

One development provides for the wavelength conversion element to be configured to convert the light of the first light beam and the light of the second light beam to deviating proportions. The wavelength conversion element can be configured to convert the light of the first light beam to a first proportion into light having a first dominant wavelength. The wavelength conversion element can be configured to convert the light of the second light beam to a second proportion into light having a second dominant wavelength. As already described above, however, it is preferred for the dominant wavelengths of the conversion light portions to be identical or substantially identical.

In other words, the conversion of the wavelength conversion element is dependent on the wavelength of the primary light. As a result, the light color can be influenced particularly well by predefining the first luminous intensity and/or the second luminous intensity.

One development provides for the light module to include a light guiding element, which is movable with respect to the first light source and/or second light source and is configured to set an impingement point on the wavelength conversion element for the first light beam and/or the second light beam, wherein the light color of the third light beam is at least partly dependent on the impingement point. The wavelength conversion element can be fashioned inhomogeneously. In various embodiments, the wavelength conversion element can have an inhomogeneous distribution of the phosphor. A particularly well adaptable and settable provision of the polychromatic light by the light module is made possible by means of the light guiding element. By way of example, the light guiding element is configured as a movable mirror or as an arrangement of micromirrors. A movable mirror can be configured as an oscillating MEMS (Microelectromechanical System) mirror that guides the primary light beam(s) over the phosphor element (linearly or in freeform fashion). In another configuration, a movable mirror can be embodied as part of a DMD (Digital Mirror Device) that directs the excitation radiation in the form of a point grid onto the phosphor.

In order to avoid an alteration of the light color of the third light beam depending on the impingement point, the control unit can be configured to predefine the first luminous intensity and/or the second luminous intensity at least partly depending on the impingement point.

One development provides for impingement points of the first light beam and of the second light beam on the wavelength conversion element to be congruent in order to overlap by a fixed amount or not to overlap. A further adaptation of the provision of the polychromatic light by the light module to a specific case of application is possible in this way.

A second aspect of various embodiments relate to a method for providing polychromatic, in various embodiments white, light, by emitting a first light beam (first primary radiation) in a first wavelength range onto a wavelength conversion element, emitting a second light beam (second primary radiation) in a second wavelength range onto the wavelength conversion element, wherein the first wavelength range and the second wavelength range have different dominant wavelengths, converting light radiated in by the first light beam at least partly into a first conversion light having a different dominant wavelength than the first light beam, converting light radiated in by the second light beam at least partly into a second conversion light having a different dominant wavelength than the second light beam, by means of the wavelength conversion element, and forming a third light beam (useful light) from the unconverted portion of the first light beam, the unconverted portion of the second light beam, and the first and/or the second conversion light.

Various embodiments provide for a first luminous intensity for the first primary light source and/or a second luminous intensity for the second primary light source to be predefined depending on a measure of the light color.

The measure of the light color can be determined by a measuring unit. By way of example, the third light beam (useful light) is split into a main part and a secondary part, wherein the main portion of the third light beam is provided toward the outside as the polychromatic light. The light color or the measure of the light color can be determined on the basis of the secondary portion of the third light beam.

One embodiment provides that the measure of the light color is determined in a calibration process, a first intensity value for the first light source and/or a second intensity value for the second light source are/is determined depending on the determined measure of the light color, and the first intensity value and/or the second intensity value are/is stored for predefining the first luminous intensity and/or the second luminous intensity. The calibration process can be carried out for example during the manufacture or after the manufacture of a light module. Production tolerances leading for example to an undesired shift in the light color can be compensated for in this way.

The light module and/or the method described can also be used in spotlights for effect lighting systems, cinema film projection, entertainment light systems, architainment lighting systems, general lighting systems, medical and therapeutic lighting systems or for plant and animal breeding.

The present embodiments thus also include a headlight/spotlight including a light module according to various embodiments. The light module of the headlight/spotlight can be configured in accordance with one or more of the embodiments described here. Consequently, expedient developments of the light module according to various embodiments or of the method according to various embodiments also develop the headlight/spotlight according to various embodiments. This can involve the headlight/spotlight for example for purposes mentioned above.

FIG. 1 shows a light module 9 including a first light source 1, a second light source 2 and a further light source 3. The light sources 1, 2, 3 are for example lasers, in particular laser diodes, or light emitting diodes (LED). The first light source 1 is configured to emit a first light beam 10 in a first wavelength range L1. The second light source 2 is configured to emit a second light beam 11 in a second wavelength range L2. The wavelength ranges L1 and L2 are illustrated by way of example in FIG. 3. By way of example, the wavelength range L1 is situated at a wavelength $\lambda$ of 440 nm and the wavelength range L2 at a wavelength $\lambda$ of 450 nm. In various embodiments, the first wavelength range L1 and the second wavelength range L2 are different. The further light source 3 can be configured to emit a further light beam 12 in a further wavelength range (not illustrated). The further wavelength range can correspond to a wavelength range L1, L2 or differ from both wavelength ranges L1, L2. For the sake of simplicity, the function of the exemplary embodiment is explained below substantially on the basis of the first light source 1 and the second light source 2.

The light beams 10, 11, 12 impinge on a wavelength conversion element 4. In the present case, a coupling unit 16 is configured to feed in the light beams 10, 11, 12 jointly onto the wavelength conversion element 4. The coupling unit 16 may include a lens optical arrangement that focuses the light of the light beams 10, 11, 12 onto a light mixing rod or beam homogenization. By way of example, the coupling unit 16 is configured to combine the light beams 10, 11, 12 and to guide them onto the wavelength conversion element 4. The light beams 10, 11, 12 can impinge on the wavelength conversion element 4 at a respective impingement point. In this case, the respective impingement points can be congruent overlap or be arranged alongside one another. If high luminances of the light module 9 are demanded, then the respective impingement points of the light beams 10, 11, 12 may be congruent.

The wavelength conversion element 4 is configured to partly absorb the light beams 10, 11, 12. By way of example, the wavelength conversion element 4 includes a phosphor or a fluorescent material. The wavelength conversion element 4 can have a thickness of for example 20 to 200 μm, e.g. of 40 to 100 μm. The wavelength conversion element 4 may include a transparent carrier material, for example sapphire. The phosphor of the wavelength conversion element 4 may include for example YAG:Ce (yttrium aluminum garnet:

cerium) with admixures of Lu (lutetium), Gd (gadolinium) or Ga (gallium). The phosphor can be present as phosphor ceramic, optionally with admixture of further materials such as e.g. $Al_2O_3$ (aluminum oxide), or as pulverant phosphor in a matrix, for example composed of silicone, glass or polysilazane.

Figure 3:
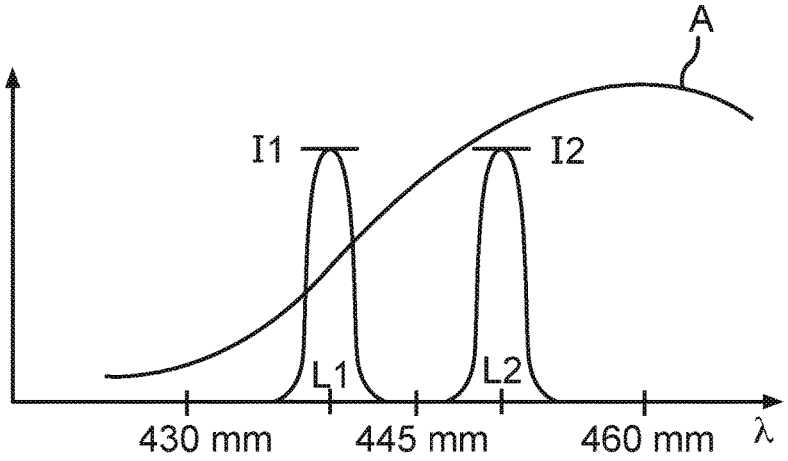
FIG. 3 shows an absorption curve of a wavelength conversion element and spectra of the primary light sources used.

FIG. 3 illustrates the absorption A of the wavelength conversion element 4 as a function of the incident wavelength λ. In this case, the absorption A is different for different wavelengths λ. In various embodiments, the absorption A is different for the first wavelength range L1 (with a luminous intensity I1) and for the second wavelength range L2 (with a luminous intensity I2). By way of example, the difference for the absorption A of the first wavelength range L1 and of the second wavelength range L2 is at least 1%, or 2% or 5%. As a result, the intensity of the converted portions of the first light beam 10 and of the second light beam 11 can likewise be different.

The light emitted by the light sources 10, 11, 12 is partly absorbed, converted in terms of its wavelength and emitted again by the wavelength conversion element 4. In various embodiments, the absorbed light is converted toward a longer wavelength with a different dominant wavelength than the assigned primary light source. The light converted by the wavelength conversion element 4 has a dominant wavelength in a third wavelength range L3, which is different than the first wavelength range and the second wavelength range. It shall be clarified at this juncture that only light absorbed by the wavelength conversion element 4 can be converted in terms of the wavelength λ.

The wavelength conversion element 4 is configured to partly transmit the light beams 10, 11, 12. The portions of the light beams 10, 11, 12 which are transmitted are not converted in terms of their wavelength. Consequently, the light beams 10, 11, 12 can pass through the wavelength conversion element 4 partly without being changed. In other embodiments (not illustrated), the wavelength conversion element 4 can be embodied in a reflective fashion. That means that the non-converted portion of the light beams 10, 11, 12 is not transmitted, but rather reflected, specifically e.g. into the same half-space from which the excitation radiation is radiated in or into which the non-converted portion of the excitation radiation is reflected. The converted portion and the non-converted portion of the light beams 10, 11, 12 are emitted in the same spatial direction e.g. both in the case of a reflective and in the case of a transmissive embodiment of the wavelength conversion element 4. The wavelength conversion element 4 can be embodied as a converter wheel. In this case, the wavelength conversion element 4 can be mounted in a rotary fashion. As a result, local overheatings of the wavelength conversion element 4 can be avoided and/or different phosphors can be illuminated depending on the rotation angle of the converter wheel.

The light converted by the wavelength conversion element 4 and the non-converted portion of the light beams 10, 11, 12 together form a third light beam 13 (also referred to as total useful light). In other words, the light beams 10, 11, 12 are partly converted in terms of their wavelength, wherein the third light beam 13 is formed by both the converted and the non-converted portions of the light beams 10, 11, 12.

Figure 4:
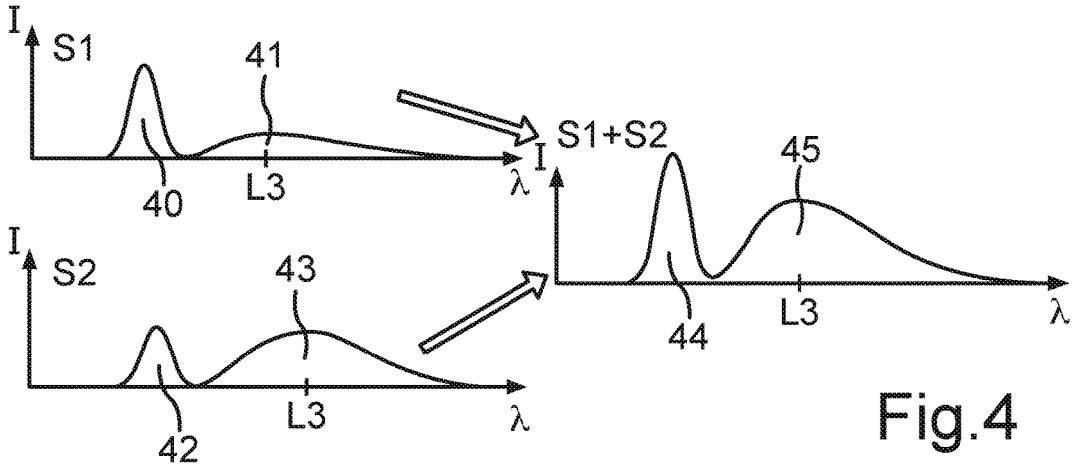
FIG. 4 shows spectra that arise in different operating states of a light module according to various embodiments.

FIG. 4 shows three spectra S1, S2, S1+S2 for elucidation purposes. The spectrum S1 is brought about for example by the first light source 1 with a luminous intensity I1. The spectrum S1 can correspond to a spectrum of the third light beam 13 if only the first light source 1 emits light. The spectrum S1 is composed of a non-converted portion 40 and a converted portion 41, namely the first conversion light.

The spectrum S2 is brought about for example by the second light source 2 with a luminous intensity I2. The spectrum S2 can correspond to a spectrum of the third light beam 13 if only the second light source 2 emits light. The second spectrum S2, too, is composed of a non-converted portion 42 and a converted portion 43, namely the second conversion light.

The non-converted relative portion 40 of the first spectrum S1 is greater than the non-converted relative portion 42 of the second spectrum S2. This is associated with the higher absorption A of the wavelength conversion element 4 for the second wavelength range L2 compared with the first wavelength range L1. On account of the profile of the absorption A, a higher relative portion of the light is transmitted in the first wavelength range L1, compared with the second wavelength range L2. The greater the absorption A for a wavelength range L1, L2 the smaller the non-converted relative portion 40, 42 of the corresponding spectrum S1, S2.

By contrast the converted relative portion 43 of the second spectrum S2 is greater than the converted relative portion 41 of the first spectrum S1. This is associated with the higher absorption A of the wavelength conversion element 4 for the second wavelength range L2 compared with the first wavelength range L1. On account of the higher absorption A for the second wavelength range L2, a larger relative portion of the light emitted in the second wavelength range L2 is converted. Compared therewith, a small relative portion of the light emitted in the first wavelength range L1 is converted. The greater the absorption A for a wavelength range L1, L2, the larger, too, the relative converted portion 41, 43 of the corresponding spectrum S1, S2.

By way of example, if both light sources 1, 2 are operated with the same luminous intensity or radiation power I1, I2, then the spectrum S1+S2 can result. In various embodiments, the spectrum S1+S2 in this case results from simple addition of the spectra S1 and S2. Consequently, the spectrum S1+S2 corresponds for example to the spectrum of the third light beam 13 if the first light source and the second light source 2 are operated with the same luminous intensity or radiation power I1, I2. The further light source 3 can be switched off in this case.

In the present case the non-converted portions 40, 42, 44 are situated in a blue wavelength range. The converted portions 41, 43, 45 (conversion light) are situated in the third wavelength range L3, which is different than the first wavelength range L1 and the second wavelength range L2. In various embodiments, the converted portions 41, 43, 45 are situated in a yellow wavelength range. Consequently, the wavelength conversion element 4 converts blue light into yellow light. On account of the higher absorption A for the wavelength range L2 compared with the wavelength range L1, the relative portion of the light of the second light source 2 which is converted into yellow light is greater than the relative portion of the light of the first light source 1 which is converted into yellow light. The wavelength ranges L1, L2 and L3 together can produce white light. The yellow conversion light 42, 43 has substantially the same dominant wavelength.

In accordance with FIG. 1, in the further course the third light beam 13 is concentrated or focused by a lens 5. In various embodiments, the lens 5 is configured to focus the third light beam 13 onto a coupling-out element 6 of the light module 9. The coupling-out element 6 is configured to split the third light beam 13 into a main portion 14 and a secondary portion 15. In other words, the coupling-out element 6 is configured to couple out the secondary portion 15.

The coupling-out element 6 in the present case is embodied as a partly transmissive mirror. The coupling-out element 6 or the partly transmissive mirror is configured for example to reflect 3% of the third light beam 13 as the secondary portion 15. Accordingly, the coupling-out element 6 or the partly transmissive mirror can be configured to transmit approximately 97% of the third light beam 13 as the main portion 14. In various embodiments, the coupling-out element 6 is configured to couple out the secondary portion 15 in a manner free of dispersion. In other words, the coupling-out element 6 can be configured to split the third light beam 13 such that the main portion 14 and the secondary portion 15 have the same spectral composition. In the present case, the coupling-out element 6 is a dichroic mirror. The dichroic mirror is configured to reflect individual wavelengths. Consequently, individual wavelengths can be coupled out as the secondary portion 15 from the third light beam 13.

The main portion 14 of the third light beam is provided toward the outside as light for illumination. In other words, an illumination purpose of the light module 9 is realized by the emission of the main portion 14. By way of example, the light module 9 is embodied as part of a headlight/spotlight. In this case, only the main portion 14 is guided visible toward the outside as light beam of the headlight/spotlight.

The secondary portion 15 is guided to a measuring unit 7. In the present case, a lens 18 is configured to focus the secondary portion 15 onto the measuring unit 7. This is because in the present case the secondary portion 15 is reflected by the coupling-out element 6 in the direction of the measuring unit 7. In addition, a diffusing plate 17 is arranged upstream of the measuring unit 7. The diffusing plate 17 serves for the additional spectral intermixing of the secondary portion 15. By way of example, angle effects during the reflection by the coupling-out element 6 can be eliminated as a result.

The measuring unit 7 includes an optical sensor 19 configured to determine a light color of the secondary portion 15. In the present case, the light color is determined as color locus according to the CIE standard colorimetric system. The optical sensor 19 of the measuring unit 7 is embodied for example as an RGB sensor. Alternatively, the optical sensor 19 includes a plurality of subsensors. The plurality of subsensors can respectively include a color filter (for example yellow and blue). Each of the plurality of subsensors can be configured to determine an intensity of a respective color range. The light color of the secondary portion 15 e.g. also corresponds to the light color of the main portion 14.

The measuring unit can additionally be configured to determine a light intensity or illuminance for the secondary portion 15. The light intensity or illuminance of the main portion 14 can be determined from the light intensity or illuminance for the secondary portion 15 (with knowledge of the exact splitting of the third light beam 13 into main portion 14 and secondary portion 15).

A control unit 8 is configured to predefine the luminous intensity I1 of the first light source 1 and the luminous intensity I2 of the second light source 2. Moreover, the control unit 8 can be configured to predefine a luminous intensity of the further light source 3.

Figure 2:
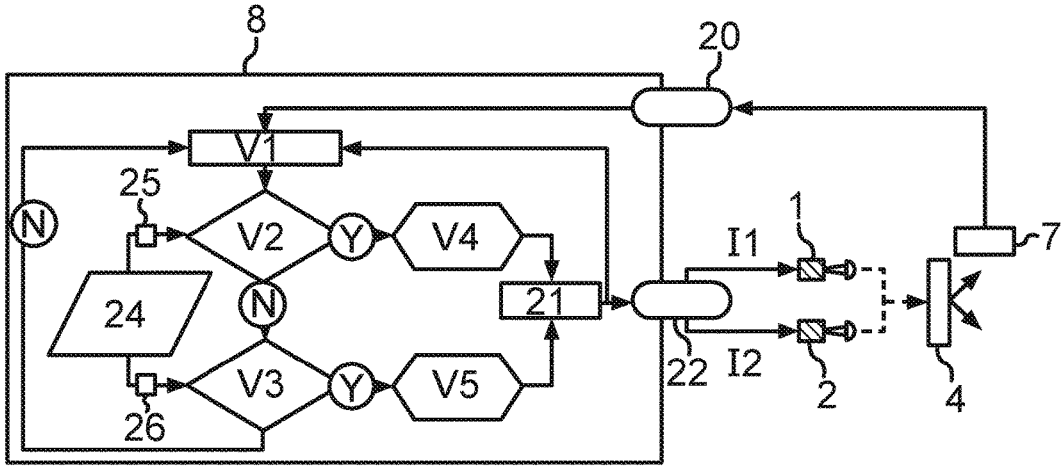
FIG. 2 shows a flow diagram of a method for providing polychromatic light, in accordance with various embodiments.

FIG. 2 shows, in the manner of a flow diagram, the regulation of the luminous intensities I1 and I2 by the control unit 8. In V1, the light color is detected from the measuring unit 7 via an interface 20. The detected light color is the light color that is determined for the secondary portion 15. In various embodiments, the light color is detected as coordinates $c_x$, $c_y$ of a color locus.

Figure 5:
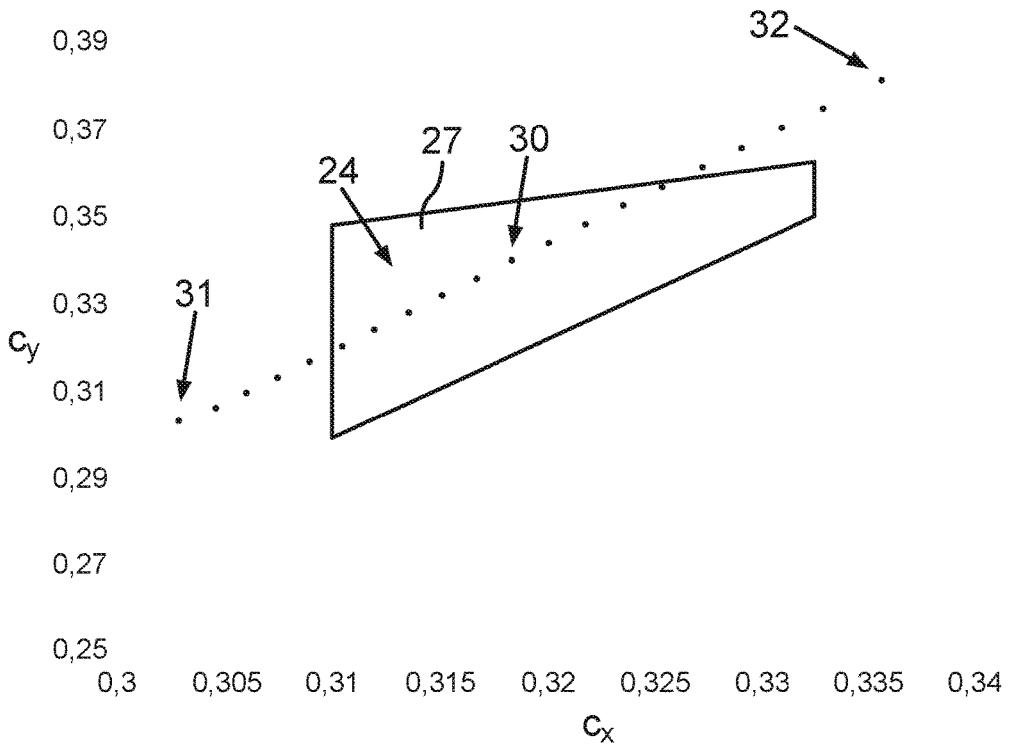
FIG. 5 shows color loci for a plurality of exemplary relative intensities of two light sources.

The light color is intended to correspond to a predefined color value 24. In the present case, the predefined color value 24 is predefined by a color window 27. Said color window 27 is illustrated in FIG. 5, for example. The coordinates $c_x$, $c_y$ of the color locus in the present case are intended to be situated within the color window 27. The color window 27 in accordance with FIG. 5 includes a white point according to the CIE standard colorimetric system. Accordingly, the light module 9 in the present case is configured for providing substantially white light. Consequently, substantially white light is emitted as the main portion 14.

In accordance with the exemplary embodiment in FIG. 2, the color window 27 or the predefined color value 24 is described by an upper limit value 25 and a lower limit value 26. V2 involves checking whether the light color or the color locus exceeds the upper limit value 25. If this is the case (Y), then a method step V4 stipulates increasing the luminous intensity I1 of the first light source 1 and reducing the luminous intensity I2 of the second light source 2.

If no exceedance of the upper limit value 25 is ascertained (N) in V2, then a subsequent method step V3 involves checking whether the light color or the color locus falls below the lower limit value 26. If this is the case (Y), then a method step V5 stipulates reducing the luminous intensity I1 of the first light source 1 and increasing the luminous intensity I2 of the second light source 2. If no undershooting of the lower limit value 26 is ascertained (N) in V3, the method begins anew in V1.

The changes in the luminous intensities I1 and I2 that are stipulated in V4 or V5 can be carried out by a driving arrangement 21. By way of example, the first light source 1 and the second light source 2 are driven via an interface 22. The light sources 1, 2 are driven for example by means of pulse width modulation (PWM) or amplitude modulation (AM) of a respective laser current of a light source 1, 2 configured as a laser.

By way of example, in the context of the driving of the light sources 1, 2, the respective luminous intensity I1, I2 is increased/reduced by a predetermined amount. In various embodiments, also after the driving of the light sources 1, 2 the method is begun anew in V1.

By predefining the luminous intensities I1, I2, it is possible to influence the light color or the color locus of the spectrum S1+S2 in accordance with FIG. 4. The luminous intensities I1, I2 predefine the proportions in which the spectrum S1 and the spectrum S2 add up to form the spectrum S1+S2. Relative to one another the spectrum S1 has for example a rather blueish and the spectrum S2 a rather yellowish color impression or color locus. By means of a higher luminous intensity I1 compared with the luminous intensity I2, the spectrum S1+S2 can be shifted for example into the blueish. By means of a higher luminous intensity I2 compared with the luminous intensity I1, the spectrum S1+S2 can be shifted for example into the reddish. In this way, by predefining the luminous intensities I1, I2, it is possible to influence the light color or the color locus of the third light beam 13.

FIG. 5 shows by way of example color loci 30, 31, 32 for different relative luminous intensities I1, I2. The color locus 30 lies within the color window 27, for example. The color locus 30 arises for luminous intensities I1, I2 in the ratio 50:50. The color locus 31 arises for luminous intensities I1, I2 in the ratio 95:5. The color locus 32 arises for luminous intensities I1, I2 in the ratio 5:95.

In addition, the measuring unit 7 can be configured to determine the light intensity or illuminance of the secondary portion 15. In this case, the driving 21 of the first light source 1 and of the second light source 2 can also be carried out depending on the light intensity or illuminance. By way of example, the control unit 8 predefines the luminous intensities I1, I2 such that the illuminance corresponds to a predefined luminous intensity value. In this way, it is possible to carry out the regulation of the light color at constant illuminance by means of the light module 9.

A method of the type mentioned above can find application for example both in the case of direct white light sources and in the case of imaging methods, such as, for example, an LARP source with DMD mirror or MEMS mirror.

The first light source 1, the second light source 2 and/or the further light source 3 can be in each case a multi-laser diode system. In other words, each of the light sources consists of a plurality of laser diodes. In this case, the laser diodes of one of the light sources respectively generate light in the same wavelength range.

The present method and the present light module 9 afford a number of advantages. Firstly, the light module 9 can be produced particularly expediently in comparison with the prior art. The requirements made of the light sources 1, 2, 3 and/or the wavelength conversion element 4 can be lowered in comparison with the prior art. In accordance with the prior art, narrowband laser diodes (laser bins) have to be used (e.g. 450 nm+/−2 nm) in order to achieve a light emission with a light color which corresponds to the predefined color value. Various embodiments make it possible to use more expedient laser diodes (laser bins) since the light color is subsequently adjusted.

Moreover, in accordance with the prior art, not every light module produced can be used, since the light color of the emitted light deviates too greatly from the predefined color value. Increasing the yield during production affords a further cost advantage of the light module according to various embodiments.

Generic light modules in accordance with the prior art often have a high temperature dependence. In various embodiments, the light emission of the light sources 1, 2, 3 can be temperature-dependent. Indeed, the conversion of the wavelength conversion element 4 can also be temperature-dependent. Therefore, a temperature-dictated shift in the light color or the color locus of the emitted light results.

The light emission of the light sources 1, 2, 3 and/or the conversion of the wavelength conversion element 4 can shift on account of aging. The present light module 9 enables subsequent adaptation of the light color or the color locus. This enables a specification in line with light emission over the entire lifetime of the light module 9.

In a further configuration of the light module 9, the control unit 8 can be configured to detect temperature values from temperature sensors 47, 48 (see FIG. 1). The temperature sensor 47 is configured for example to determine a temperature at one or more of the light sources 1, 2, 3. The temperature sensor 48 is configured for example to detect a temperature at the wavelength conversion element 4. If the temperature dependence of the light sources 1, 2, 3 and/or of the wavelength conversion element 4 is known, the light color determined by the measuring unit 7 can be plausibilized on the basis of the temperature values from the temperature sensor 47, 48. In various embodiments, this involves determining whether the light color determined is possible for the temperature values detected. Measurement errors can be identified as a result. Secondly, the accuracy of the determination of the light color can be increased further.

In another embodiment of the light module 9, this embodiment not being shown in the figures, the light color can be determined exclusively on the basis of the temperature values from the temperature sensors 47, 48. The measuring unit 7 can be omitted in this case. A particularly simple adaptation of the light color or the color locus is possible as a result.

Figure 7:
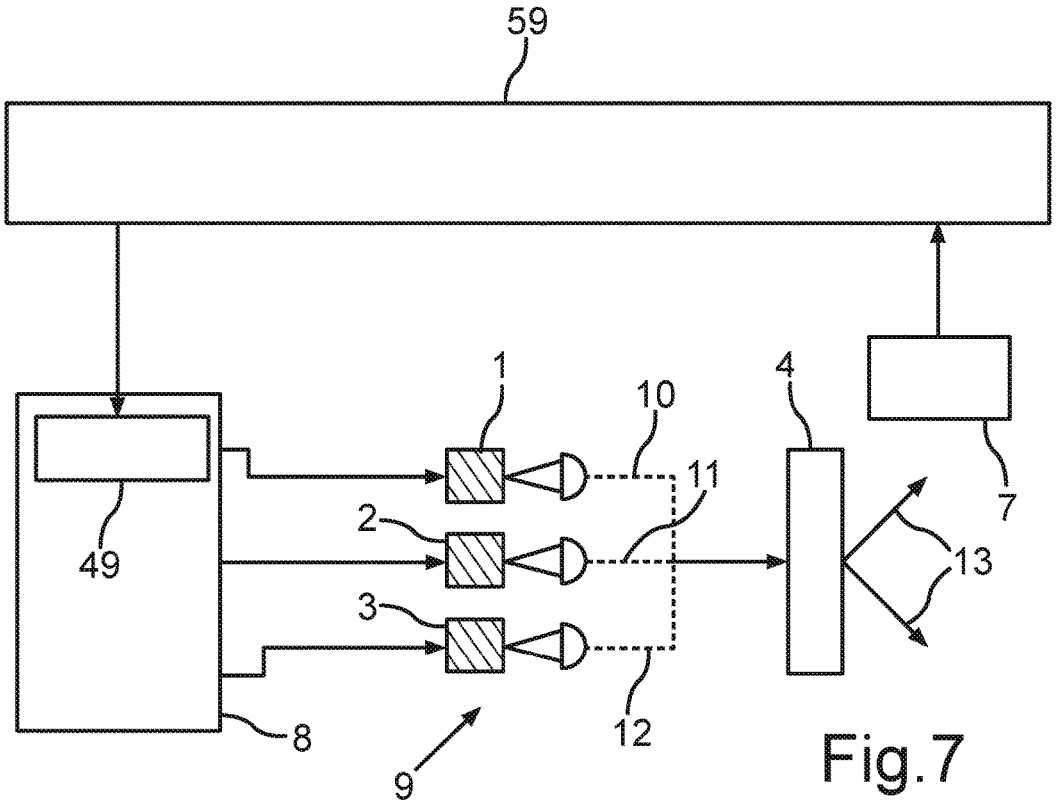
FIG. 7 shows a schematic illustration of a device for calibrating the luminous intensities.

In accordance with another exemplary embodiment according to FIG. 7, the light module may include a storage unit 49, for example an EEPROM. Configuration data can be storable in the storage unit 49. The configuration data include for example a first intensity value for the first luminous intensity I1 and a second intensity value for the second luminous intensity I2. By means of the first intensity value and the second intensity value it is possible for example to predefine a respective electric current or a respective electrical power for the first light source 1 and the second light source 2. A further intensity value can be stored for the further light source 3. By means of the respective intensity value, it is possible to predefine the luminous intensity I1, I2 for each of the light sources 1, 2, 3. The control unit 8 is configured to retrieve the intensity values from the storage unit 49 and to predefine the luminous intensities I1, I2 in accordance with the intensity values.

By way of example, the light color or the color locus of the emitted light is determined in the context of a calibration process. The calibration process is carried out in particular at the factory after the end of the process for producing the light module 9. By way of example, the measuring unit 7 in accordance with FIG. 7 is part of a manufacturing system 59. In the context of the calibration process, the light color or the color locus can then be set to the predetermined color value 24 or the color window 27 by predefining the first luminous intensity I1 and/or the second luminous intensity I2. The first intensity value and the second intensity value can be determined from the luminous intensities I1, I2 predefined in the context of the calibration process. At the end of the calibration process, the intensity values are stored in the storage unit 49.

Figure 6:
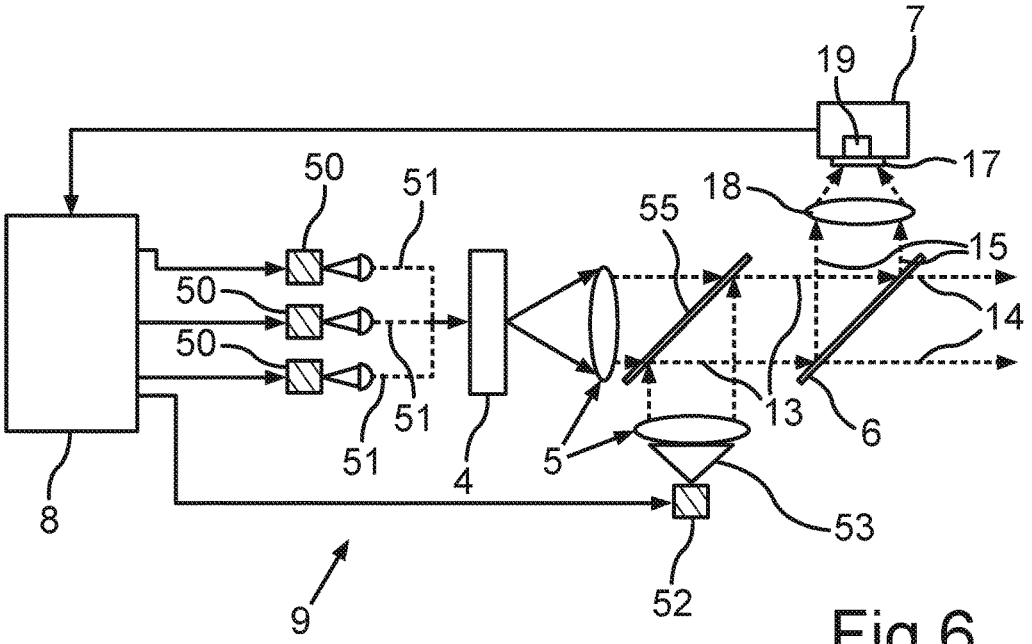
FIG. 6 shows a schematic illustration of a light module for providing polychromatic light, in accordance with various embodiments.

FIG. 6 shows another embodiment of the light module 9. In this case, the light module 9 includes a plurality of first light sources 50. The first light sources 50 emit a respective first light beam 51 onto the wavelength conversion element 4. A second light source 52 is configured to emit a second light beam 53 directly. Directly means, for example, that the second light beam 53 is not converted by the wavelength conversion element 4. The wavelength conversion element 4 does not lie in the beam path of the second light beam 53. Analogously to the embodiments in accordance with FIG. 1 and FIG. 2, the light color of the third light beam 13 can be predefined by the respective luminous intensities of the first light sources 50 and of the second light source 52. The first light sources 50 can emit light having the same or having different features.

A coupling-in element 55 is configured to couple the second light beam 53 into the converted portion and the non-converted portion of the first light beam 51. By way of example, the coupling-in element 55 is embodied as a dichroic mirror. In the example in accordance with FIG. 6, the third light beam 13 is formed from the converted portion and the non-converted portion of the first light beam 51 and the second light beam 53 by the coupling-in element 55.

In this embodiment, the directly emitting second light source 52 serves to admix a blue portion with the third light beam 13. The color locus or the light color of the third light beam 13 can be set depending on the intensity of the admixed blue portion. In other embodiments (not shown), directly emitting light sources can be configured for admixing other color portions. In various embodiments, a plurality of directly emitting light sources can be configured for admixing different color portions.

Figure 8:
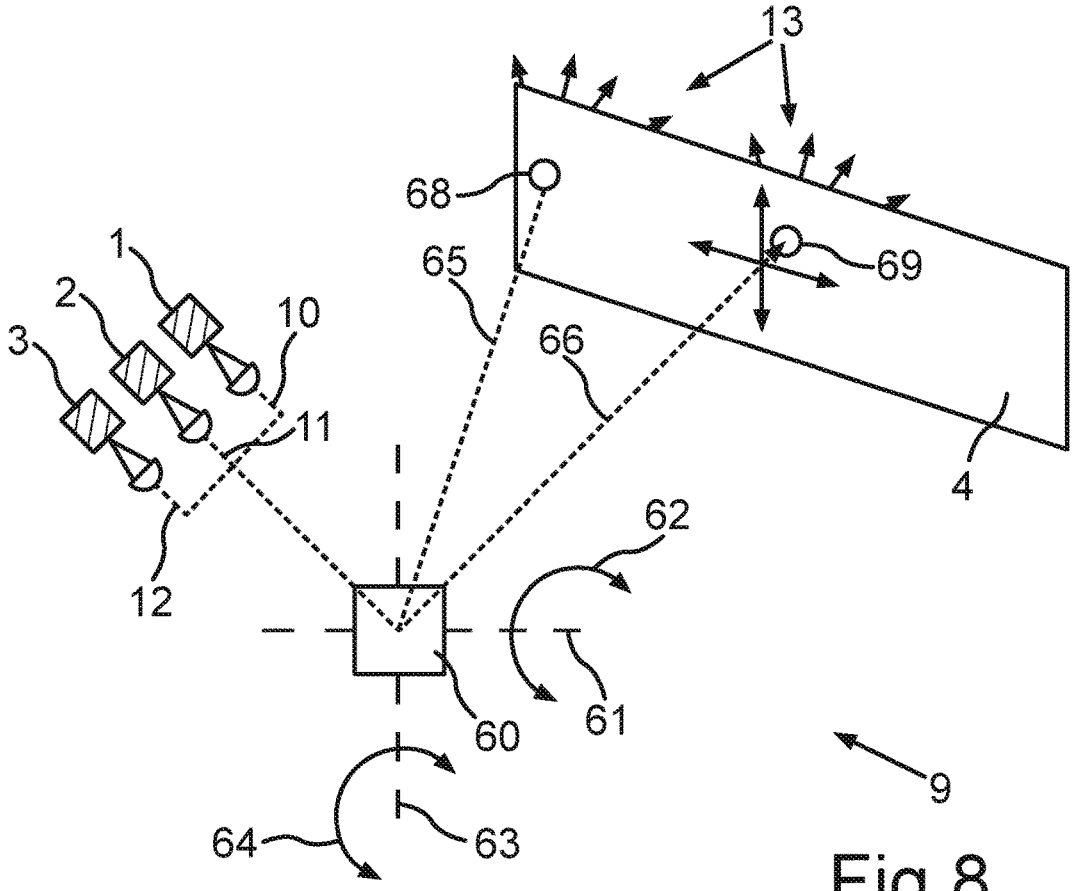
FIG. 8 shows a schematic illustration of a light module for providing polychromatic light, in accordance with a further exemplary embodiment (using a MEMS mirror).

FIG. 8 shows a further embodiment of a light module 9 including a light guiding element 60. The light guiding element 60 can be embodied as a mirror element, e.g. as an arrangement of an oscillating light mirror. The oscillation can be configured in a resonant or non-resonant fashion and be effected in one axis or in two axes. Such an embodiment is also called "MEMS-LARP". In the present case, the light guiding element 60 is configured to predefine an emission direction 65, 66 for the light emitted by the light sources 1, 2, 3, e.g. the first light beam 10, the second light beam 11 and the further light beam 12. By predefining the emission direction 65, 66, the light module 9 enables a particularly advantageous and adaptable illumination of a space to be illuminated. By way of example, the light module 9 in accordance with FIG. 8 is configured as a vehicle headlight. In this example, a cornering light function or a high-beam light function can be made possible by predefining the emission direction 65, 66.

The light guiding element 60 can have two rotation axes 61, 63 for the movement of the light guiding element 60 in accordance with two spatial directions 62, 64. One of the emission directions 65, 66 can be set by the movement of the light guiding element 60. Different impingement points 68, 69 of the light of the light sources 1, 2, 3 on the wavelength conversion element 4 can result depending on the emission direction 65, 66. By way of example, the impingement point 68 results for the emission direction 65 and the impingement point 69 for the emission direction 66.

On account of inhomogeneities in the phosphor distribution of the wavelength conversion element 4, the light color of the third light beam 13 can be dependent on the respective impingement point 68, 69. In this case, the control unit 8 (not shown in FIG. 8) can be configured to predefine the respective luminous intensities for the light sources 1, 2, 3 at least partly depending on the impingement point 68, 69 and/or the emission direction 65, 66.

By way of example, the dependence of the light color of the third light beam 13 on the impingement point 68, 69 can be determined by calibration. In this case, the control unit 8 can be configured to determine the emission direction 65, 66 and, depending thereon, to set the respective luminous intensities for each of the light sources 1, 2, 3. In addition, the respective luminous intensities of the light sources 1, 2, 3 can be dependent on configuration data from the storage unit 49 and/or temperature values from one or more of the temperature sensors 47, 48.

It goes without saying that the embodiment of the light module in accordance with FIG. 8 can be combined with a measuring unit 7 and/or a coupling-out element 6. This is not illustrated in the figures for reasons of clarity.

LIST OF REFERENCE SIGNS

1 Light source
2 Light source
3 Light source
4 Wavelength conversion element
5 Lens
6 Coupling-out element
7 Measuring unit
8 Control unit
9 Light module
10 first light beam
11 second light beam
12 further light beam
13 third light beam
14 Main portion
15 Secondary portion
16 Coupling unit
17 Diffusing plate
18 Lens
20 Interface
21 Driving arrangement
22 Interface
24 Color value
25 upper color limit value
26 lower color limit value
27 Color window
30 Color locus
31 Color locus
32 Color locus
40 non-converted portion
41 converted portion
42 non-converted portion
43 converted portion
44 non-converted portion
45 converted portion
47 Temperature sensor
48 Temperature sensor
49 Storage unit
50 Light source
51 first light beam
52 Light source
53 second light beam
55 Coupling-in element
59 Manufacturing system
60 Light guiding element
61 Rotation axes
62 Spatial direction
63 Rotation axes
64 Spatial direction
65 Emission direction
66 Emission direction
68 Impingement point
69 Impingement point
V1 . . . V5 Method steps
51 Spectrum
S2 Spectrum
S1+S2 Spectrum
I Intensity
Λ Wavelength
A Absorption
L1,L2 Wavelength ranges
I1,I2 Luminous intensities
$C_x$,$c_y$ Color coordinates While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A light module for providing polychromatic light, the light module comprising:

a wavelength conversion element;

a first light source for emitting a first light beam in a first wavelength range onto the wavelength conversion element; and at least one second light source for emitting a second light beam in a second wavelength range;

wherein the first wavelength range and the second wavelength range differ in their dominant wavelength;

wherein the wavelength conversion element is configured to convert primary light radiated in by the first light beam at least partly into a first conversion light and to convert primary light radiated in by the at least one second light beam at least partly into a second conversion light;

wherein at least the first conversion light and the second conversion light together form a third light beam;

the light module further comprising a control unit configured for predefining at least one of a first luminous intensity for the first light source or a second luminous intensity for the at least one second light source depending on a measurement of the light color of the third light beam.

2. The light module of claim 1, wherein the control unit is configured to set the light color to a predefined color value by predefining the first luminous intensity and/or the second luminous intensity.

3. The light module of claim 1, further comprising:

a storage unit configured to store a first intensity value for the first luminous intensity and a second intensity value for the second luminous intensity.

4. The light module of claim 1, further comprising:

a measuring unit configured to determine a measure of the light color of the third light beam.

5. The light module of claim 4, further comprising:

a coupling-out element arranged in a beam path of the third light beam;

wherein the coupling-out element is configured to split the third light beam into a main portion and a secondary portion;

wherein the light module is configured to provide the main portion of the third light beam toward the outside as the polychromatic light; and wherein the measuring unit is configured to determine the measure of the light color on the basis of the secondary portion of the third light beam.

6. The light module of claim 5, wherein the coupling-out element is configured, for splitting the third light beam, to transmit the main portion of the third light beam and to reflect the secondary portion of the third light beam.

7. The light module of claim 5, wherein the coupling-out element is configured to split the third light beam into the main portion and the secondary portion according to a predefined ratio.

8. The light module of claim 5, wherein the measuring unit is configured to determine an illuminance for the secondary portion of the third light beam; and wherein the control unit is configured to set the illuminance to a predefined luminous intensity value by predefining at least one of the first luminous intensity or the second luminous intensity.

9. The light module of claim 1, wherein at least one of the first wavelength range or the second wavelength range lie in a blue wavelength range.

10. The light module of claim 1, wherein the control unit is configured to detect the measure of the light color on the basis of a temperature from a temperature sensor.

11. The light module of claim 1, wherein the wavelength conversion element is configured to convert the light of the first light beam and the light of the second light beam to deviating proportions.

12. The light module of claim 1, further comprising:

a light guiding element, which is movable relative to the first light source and/or second light source and is configured to set an impingement point on the wavelength conversion element for the first light beam and/or the second light beam;

wherein the light color of the third light beam is at least partly dependent on the impingement point.

13. A headlight, comprising:

a light module, comprising:

a wavelength conversion element;

a first light source for emitting a first light beam in a first wavelength range onto the wavelength conversion element; and at least one second light source for emitting a second light beam in a second wavelength range;

wherein the first wavelength range and the second wavelength range differ in their dominant wavelength;

wherein the wavelength conversion element is configured to convert primary light radiated in by the first light beam at least partly into a first conversion light and to convert primary light radiated in by the at least one second light beam at least partly into a second conversion light;

wherein at least the first conversion light and the second conversion light together form a third light beam;

the light module further comprising a control unit configured for predefining a first luminous intensity for the first light source and/or a second luminous intensity for the at least one second light source depending on a measurement of the light color of the third light beam.

14. A spotlight, comprising:

a light module, comprising:

a wavelength conversion element;

a first light source for emitting a first light beam in a first wavelength range onto the wavelength conversion element; and at least one second light source for emitting a second light beam in a second wavelength range;

wherein the first wavelength range and the second wavelength range differ in their dominant wavelength;

wherein the wavelength conversion element is configured to convert primary light radiated in by the first light beam at least partly into a first conversion light and to convert primary light radiated in by the at least one second light beam at least partly into a second conversion light;

wherein at least the first conversion light and the second conversion light together form a third light beam;

the light module further comprising a control unit configured for predefining a first luminous intensity for the first light source and/or a second luminous intensity for the at least one second light source depending on a measurement of the light color of the third light beam.

15. A method for providing polychromatic light, the method comprising:

emitting a first light beam in a first wavelength range onto a wavelength conversion element;

emitting a second light beam in a second wavelength range onto the wavelength conversion element;

converting light radiated in by the first light beam at least partly into a first conversion light having a different dominant wavelength than the first light beam, by means of the wavelength conversion element;

converting light radiated in by the second light beam at least partly into a second conversion light having a different dominant wavelength than the second light beam; and forming a third light beam at least from the first conversion light and the second conversion light;

wherein at least one of a first luminous intensity for the first light source or a second luminous intensity for the second light source are/is predefined depending on a measure of the light color.

16. The method of claim 15, wherein the measure of the light color is determined in a calibration process;

wherein at least one of a first intensity value for the first light source or a second intensity value for the second light source are/is determined depending on the determined measure of the light color; and wherein at least one of the first intensity value or the second intensity value are/is stored for predefining at least one of the first luminous intensity or the second luminous intensity.

* * * * *